US006057751A

United States Patent [19]

Hung et al.

[11] Patent Number: 6,057,751

[45] Date of Patent: May 2, 2000

[54] OVERHEAT AND OVERLOAD SENSING DEVICE

[76] Inventors: Kuang-Tsan Hung; Chun-Wei Hsu, both of No. 4, Lane 92, Kuan-Kuang Street, Pen-Chiao City, Taipei, Taiwan

[21] Appl. No.: 09/241,067

[22] Filed: Feb. 1, 1999

[51] Int. Cl.[7] ..... H01H 37/14; H01H 37/52; H01H 61/02

[52] U.S. Cl. ..... 337/377; 337/333; 337/334; 337/370; 337/37; 337/59; 337/102

[58] Field of Search ..... 337/333, 334, 337/343, 376, 374, 377, 381, 14, 16, 23, 36, 32, 39, 59, 66, 79, 100, 102, 370

[56] References Cited

U.S. PATENT DOCUMENTS

| | | | |
|---|---|---|---|
| 3,737,825 | 6/1973 | Summe et al. | 337/91 |
| 4,092,623 | 5/1978 | Kirkup | 337/66 |
| 4,123,737 | 10/1978 | Hoagland, Jr. | 337/68 |
| 4,329,669 | 5/1982 | Krasser et al. | 335/20 |
| 4,337,450 | 6/1982 | Matthies | 337/66 |
| 4,345,233 | 8/1982 | Matthies | 337/75 |
| 4,363,016 | 12/1982 | Unger | 337/56 |
| 4,528,538 | 7/1985 | Anderson | 337/43 |
| 5,012,495 | 4/1991 | Munroe et al. | 337/3 |
| 5,079,530 | 1/1992 | Tsuchiyama | 335/17 |
| 5,089,799 | 2/1992 | Sorenson | 337/68 |
| 5,262,748 | 11/1993 | Tsung-Mou | 337/66 |
| 5,453,725 | 9/1995 | You et al. | 337/68 |
| 5,539,371 | 7/1996 | Yu | 337/66 |
| 5,694,106 | 12/1997 | Wang | 337/79 |
| 5,898,355 | 4/1999 | Yu | 337/8 |

FOREIGN PATENT DOCUMENTS

| | | | |
|---|---|---|---|
| 363269432A | 11/1988 | Japan | H01H 73/22 |
| 408212824A | 8/1996 | Japan | F21V 23/00 |

*Primary Examiner*—Leo P. Picard
*Assistant Examiner*—Anatoly Vortman
*Attorney, Agent, or Firm*—Bacon & Thomas

[57] ABSTRACT

An overheat and overload sensing device includes a thermal sensor (such as a thermal regulator) and a breaker connected in parallel and used to cut off a power supply in case of current overload. The thermal sensor usually disposed near a heat source can respond automatically to cut off a local circuit in time in the case of overheat that will make the breaker become overloaded to break off power supply.

10 Claims, 10 Drawing Sheets

OVERHEAT AND OVERLOAD SENSING DEVICE

BACKGROUND OF THE INVENTION

This invention relates to an overheat and overload sensing device, and particularly to a sensing device that combines a thermal breaker sensor to a circuit breaker for integral design. In the case of overheat the present device can respond automatically to cut off a local circuit that makes the breaker become overloaded to break off the power supply.

A fuse or no fuse breaker is usually applied in a power supply circuit for protection of electrical appliances against damage when overloading. However, the usual breaker seems useless in the case of overheat. For instance, U.S. Pat. No. 5,539,371, U.S. Pat. No. 5,453,725 and U.S. Pat. No. 5,694,106 are concerned with the abovesaid automatic breaker that can shut down power supply if, and only if, a circuit is overloaded electrically. An ordinary fuse or automatic breaker cannot respond to overheat of household electrothermal appliances, such as a drinking water supplier, juice maker, or coffee pot, etc. as long as electric current is kept under rated value. A coffee pot, for example, usually contains at least a water tank and a heating device for heating water in the tank. When power is supplied, the heating device will consecutively heat the water tank. When water in the tank is used up or evaporated and the tank becomes empty, if the heating device is not stopped in time under this circumstance, internal parts off the drinking water supplier will probably be destroyed, or the supplier itself may be burnt, becoming thoroughly damaged, and incurring unexpected danger.

SUMMARY OF THE INVENTION

This invention is proposed to provide an automatic power breaker that can detect both overload and overheat, and shut down the power supply no matter which happens. The practiced manner is to dispose a thermal-sensing device in parallel connection in the breaker, so that a sensed overheat signal will be converted into that of an overload to shut down the power supply for achieving multi-purpose protection.

BRIEF DESCRIPTION OF THE DRAWINGS

For better understanding of the present invention, together with further advantages or features thereof, at least one preferred embodiment will be elucidated below with reference to the annexed drawings in which.

DETAILED DESCRIPTION OF THE PREFERRED EMBODIMENT

Figure 1A:
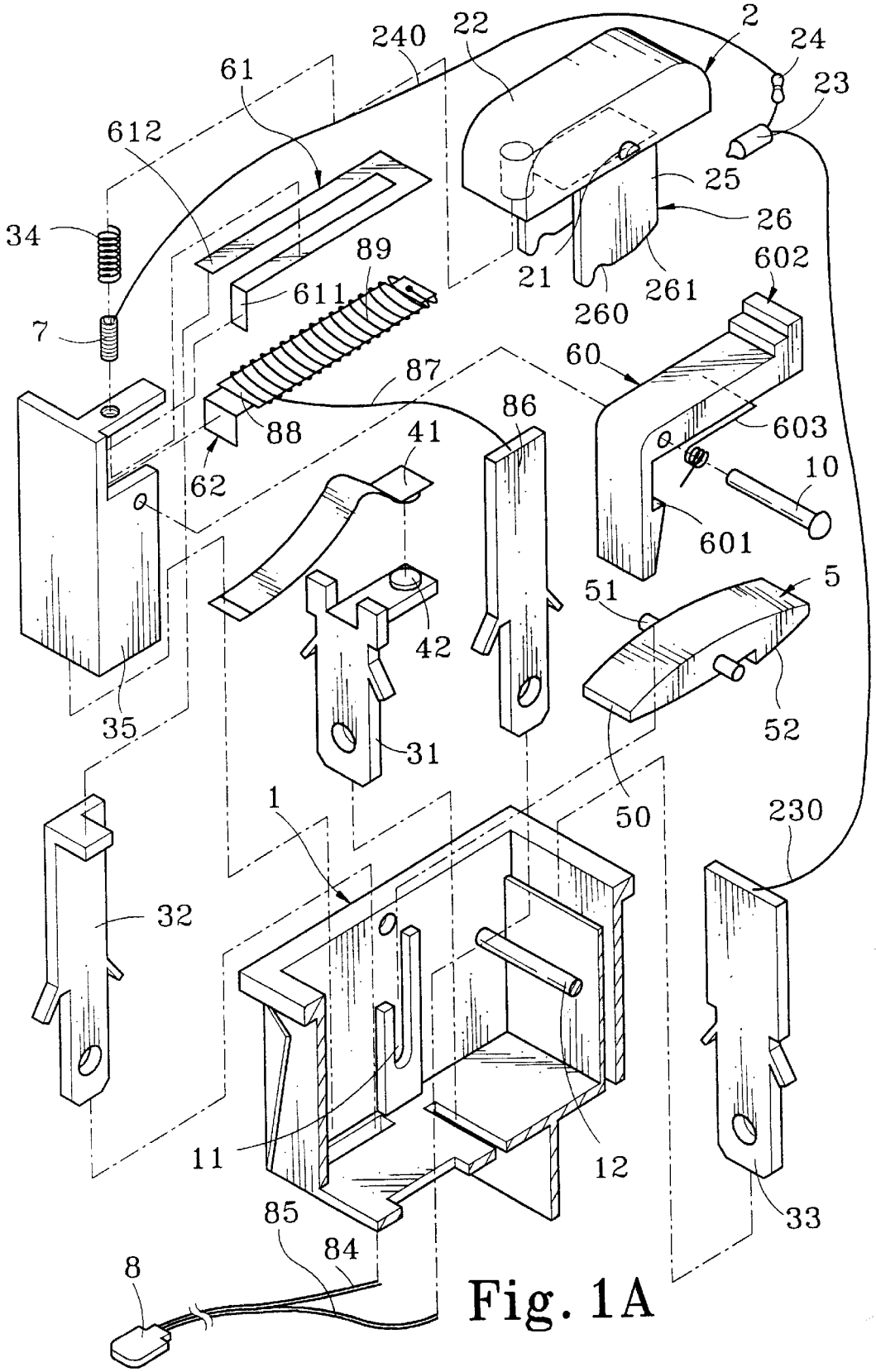
FIG. 1A is a lateral exploded view showing assembly of the $1^{st}$ embodiment of this invention.
Figure 1B:
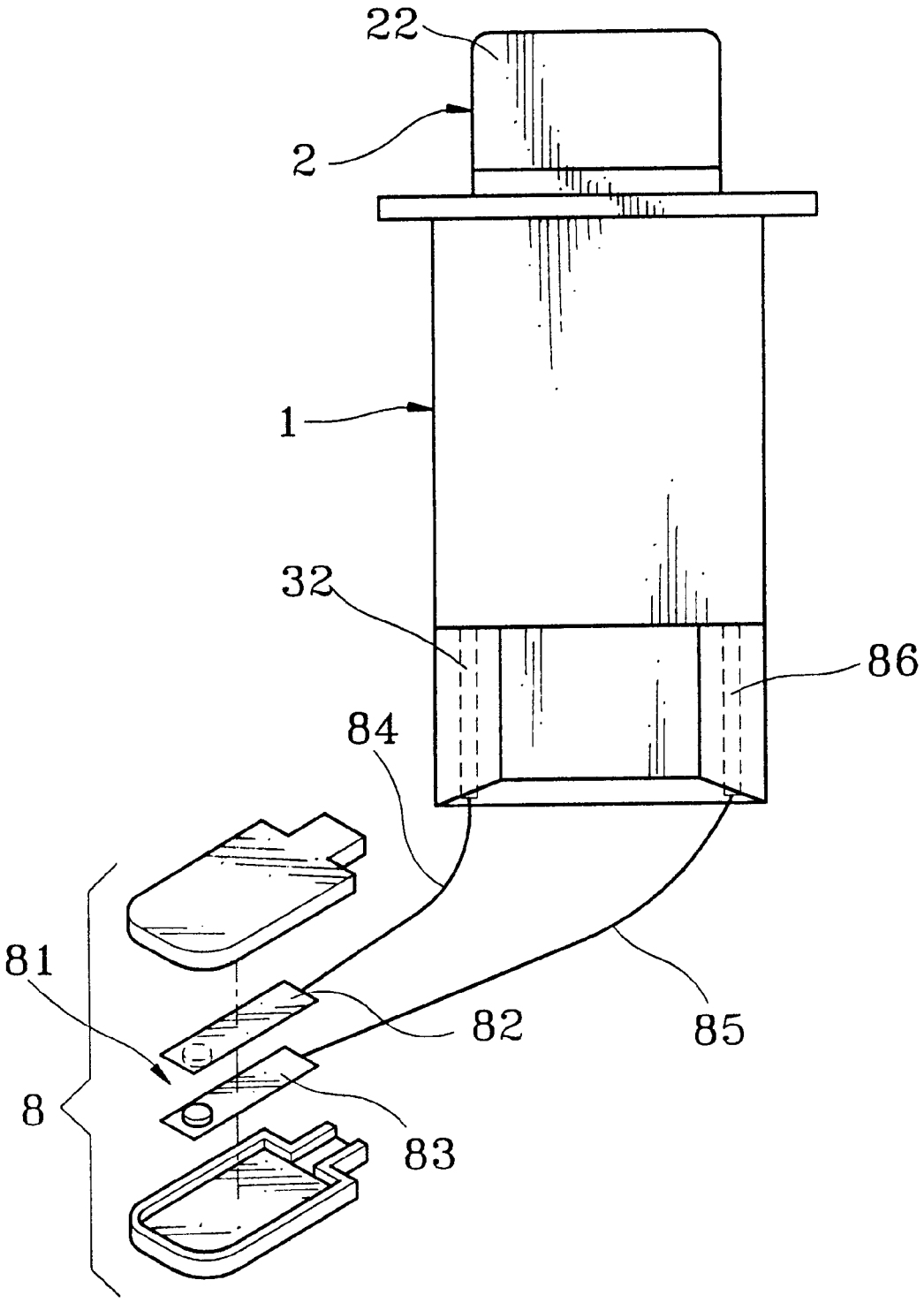
FIG. 1B is a lateral schematic view showing assembly of the $1^{st}$ embodiment of this invention.
Figure 2:
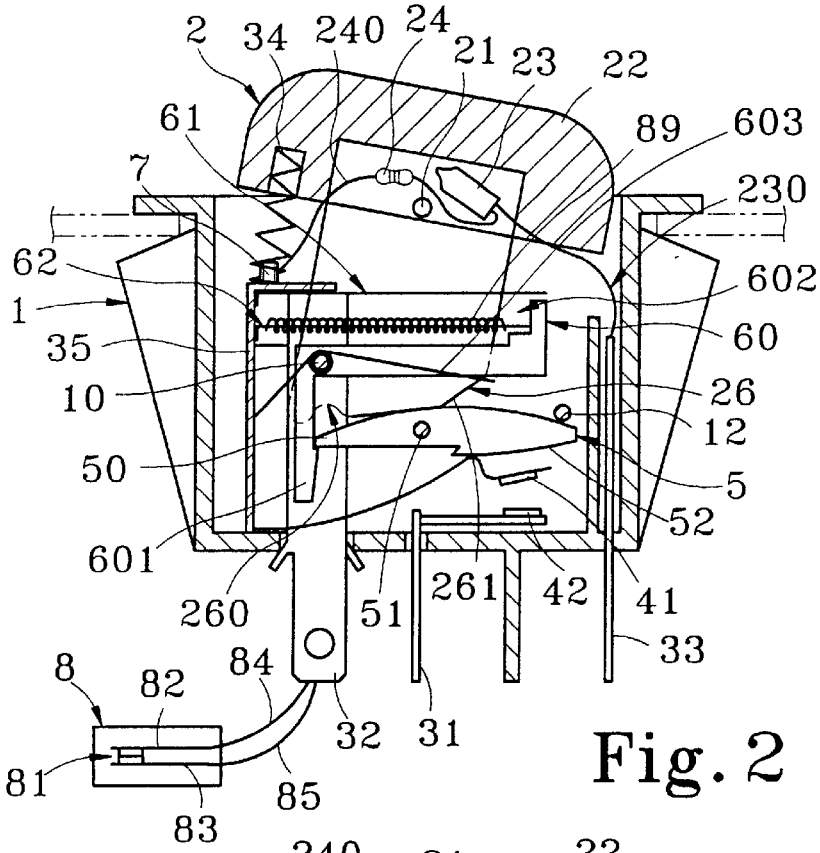
FIG. 2 is a cutaway sectional view showing an "OPEN" state of the $1^{st}$ embodiment of this invention.

As shown in FIGS. 1A, 1B, and 2, the $1^{st}$ embodiment includes a breaker and a thermal-sensing device connected in parallel with the breaker, wherein the breaker comprises an insulated housing unit 1, an ON/OFF knob 2 disposed on the housing unit 1 by means of a pivot 21, where the knob can move like a seesaw; a plurality of fixed terminals 31,32,33 inserted in the housing unit 1 for electrical connection to power supply or devices; a pair of normally open contact points formed by movable contact points 41,42 and $1^{st}$ and $2^{nd}$ fixed terminals 31, 32; a movable lever 5 used to drive the movable contact points 41,42 to form a closed circuit; and a release mechanism used to drive the movable lever 5 to restore it back to the normally open state, where the movable contact point 41 connects to an adaptive article 35.

The ON/OFF knob 2 consists of a transparent hollow cover 22, a bulb 23 disposed in the hollow cover 22, a resistor 24 connected with the bulb 23 in series, and a spring 34 disposed on the adaptive article 35 for pushing the cover 22 to a normally open position, wherein one end of the resistor 24 connects to a pin of the bulb 23; the other pin 230 of the bulb 23 connects electrically to the $3^{rd}$ fixed terminal 33; and the other end 240 of the resistor 24 is in electrical connection with the adaptive article 35.

The ON/OFF knob 2 further includes a trigger 25 located at bottom of the cover 22 swinging back and forth to an action or inaction position following seesaw movement of the cover 22. The trigger 25 contains at least an action face 26 that keeps constant contact with the movable lever 5. The action face 26 contains an action point 260 and an inaction point 261, which are located on the bottom edge of the action face 26 at two sides, and the distance from the pivot 21 to the action point 260 is slightly longer than that to the inaction point 261.

The movable lever 5 comprises at least: a supporting portion 50 near the $2^{nd}$ fixed terminal movable within a range confined by $1^{st}$ and $2^{nd}$ support points; a force-applying portion 52 at an opposite end of the supporting portion 50 in constant touch with the movable contact points 41,42; and a force-resisting portion 51 in constant touch the action face 26. The force-resisting portion 51 is limited to reciprocate in a straight line for driving the movable contact point 41 to form, with the $1^{st}$ and $2^{nd}$ fixed terminals 31,32, a normally open or closed contact point. As shown in FIG. 1A, two ends of the cylindrical force-resisting portion 51 are limited to reciprocate in a straight line in a recessed track 11 erected oppositely on an inner wall of the housing unit 1.

The release mechanism comprises: a movable article 60 keeping the supporting portion 50 at a $1^{st}$ support point; and a thermal bi-metal strip 61 releasing the supporting portion 50 to a support point. The movable article 60 is laid on a pivotal article 10 for pivoting, and at a bottom end of the movable article 60, a reverse hook portion 601 is formed to maintain the supporting portion 50 at the $1^{st}$ support point. A restoring spring 603 (a torque spring as shown in FIGS. 1A and 2) disposed laterally to the movable article 60 is used to enable the reverse hook portion 601 to normally restrain the supporting portion 50. The thermal bi-metal strip 61 comprises the $1^{st}$ fixing end 611 anchored at the adaptive article 35, the $2^{nd}$ fixing end 612 anchored at the $2^{nd}$ fixed terminal 32, and a push end 613 of step top 602 to drive the movable article 60 when the thermal bi-metal strip 61 is heated to bend.

The thermal-sensing device is packed in a casing unit 8, wherein a sensing mechanism 81 is provided, which contains a $4^{th}$ fixed point 82 and a $2^{nd}$ movable contact point 83 made of a thermal bi-metal strip. The $4^{th}$ fixed point 82 and the $2^{nd}$ movable contact point 83 are connected to the $2^{nd}$ fixed terminal 32 and an insertion pin 86 respectively via lead wires 84,85, and the insertion pin 86 is further connected via a lead wire 87 to a thermal bi-metal strip 62 which is in electrical connection with the adaptive article 35 to thus form a parallel connection of the thermal-sensing device to the breaker. A rear end of the lead wire 87 is coupled to a heating coil 89 which is wound on an insulation layer 88 disposed on the outer surface of the thermal bi-metal strip 62. In the case of overheat, the $2^{nd}$ movable contact point 83 will deform to detach from the $4^{th}$ fixed point 82 to enter an OPEN state. Meanwhile, the thermal bi-metal strip 62 is heated to bend to push the step top 602 of the movable article 60 owing to the high temperature of the heating coil 89.

Figure 15:
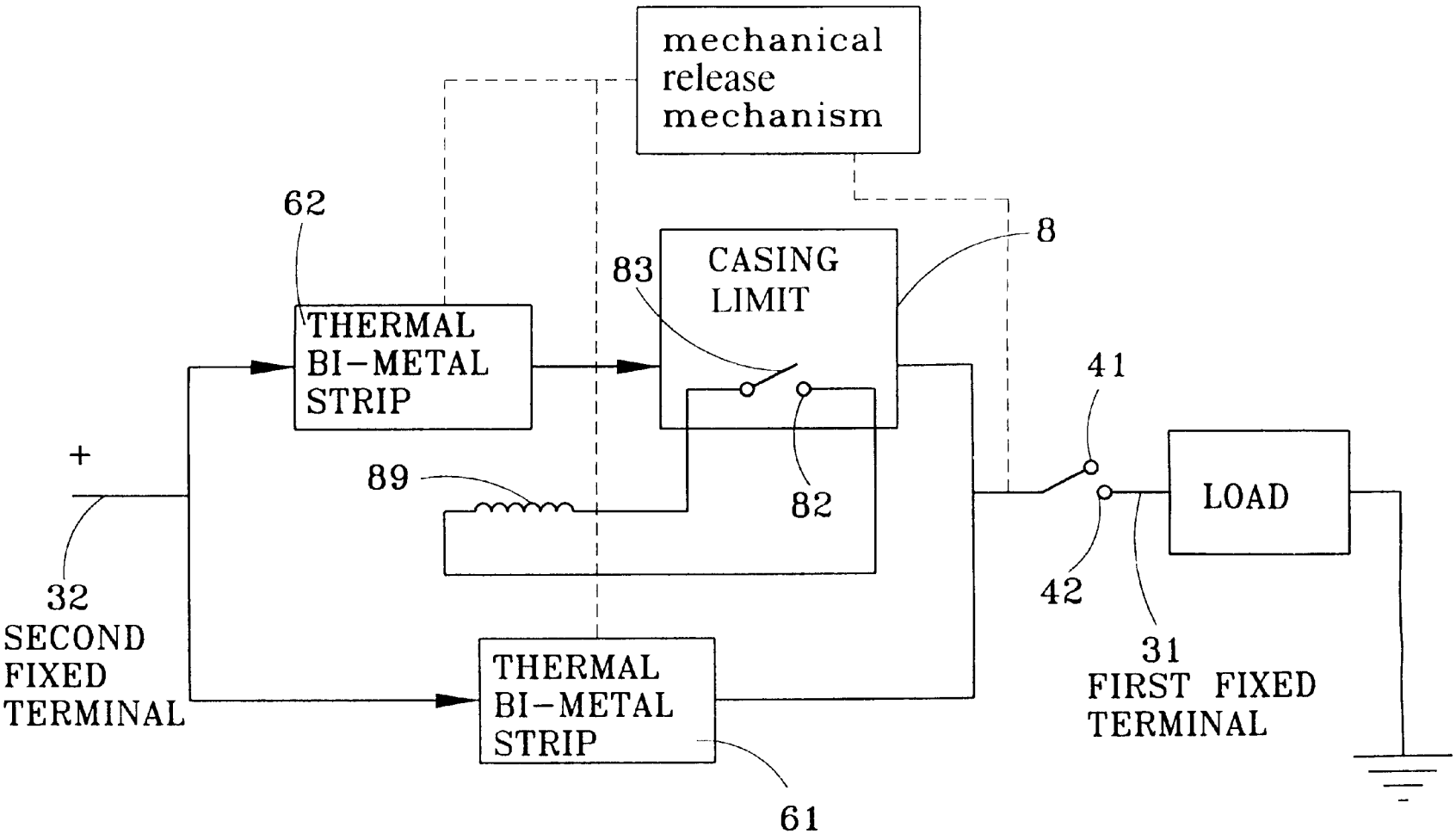
FIG. 15 is a block diagram of the electrical connections to the contact points and thermal bi-metal strips.

As shown in FIG. 15, if the temperature of an appliance where the casing unit is placed exceeds a predetermined value of temperature of the second movable contact point 83, then the casing unit will become OPEN, i.e., the movable contact points will no longer contact with the $4^{th}$ fixed terminal 82 to form a closed circuit. Therefore, the current will be altered to pass through the heating coil 89 having a bearable current 1A, and heated by an excessive current higher than the bearable current, causing a deformation of thermal bi-metal strip 62 to push movable article 60. In addition, if the thermal bi-metal strip 61 having a bearable current 15A is heated due to an overload, the resetting deformation will also cause the movable article 60 to be pushed.

Figure 3:
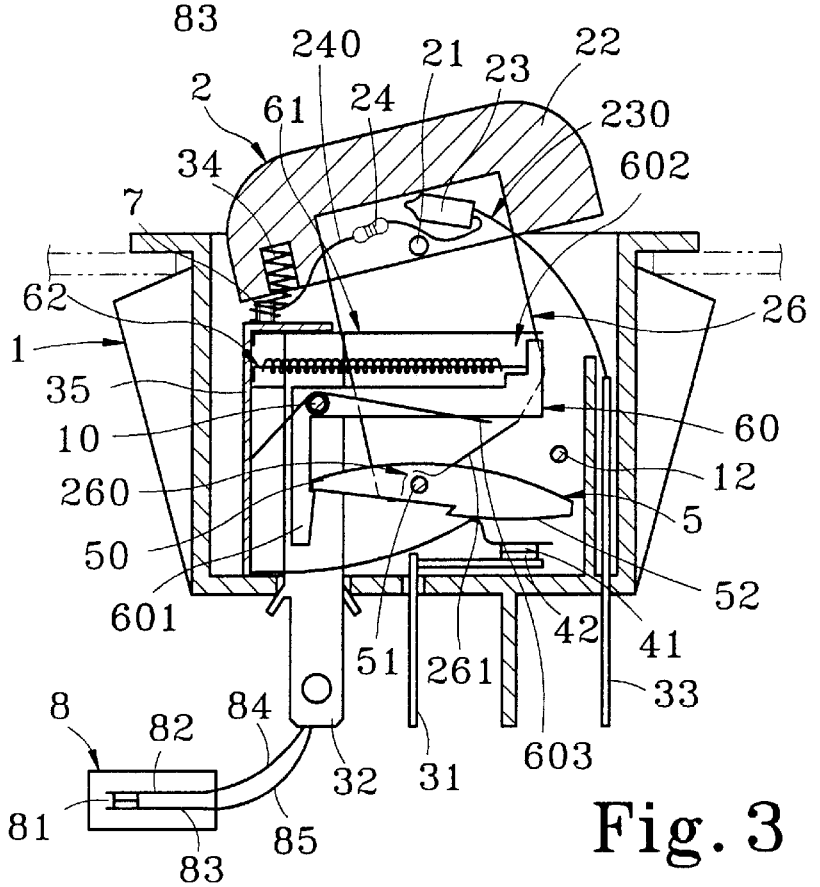
FIG. 3 is a cutaway sectional view showing a "CLOSE" state of the $1^{st}$ embodiment of this invention.

As shown in FIG. 2, when the breaker is in the "OPEN" state, the force-resisting portion 51 is sitting on the inaction point 261 and is pushed to cock up by elastic force of the movable contact point 41, while the supporting portion 50 is hooked at the $1^{st}$ support position by the reverse hook portion 601. As the movable contact points 41,42 are detached from each other under this circumstance, power wires connected to the $1^{st}$ and $2^{nd}$ fixed terminals 31,32 respectively cannot form a close circuit. On the contrary, when the ON/OFF knob 2 is pushed to enter a state as shown in FIG. 3, the force-resisting portion 51 moves to the action point 260 along the action face 26, and as the distance between the action point 260 and the pivot 21 is greater than that between the inaction point 261 and the pivot 21, the force applying portion 52 presses the movable contact point 41 to contact another movable contact point 42 to form a closed circuit with the power wires connected to the $1^{st}$ and $2^{nd}$ fixed terminals 31,32 respectively. Meanwhile, as long as the temperature of an electrothermal appliance is lower than a critical temperature that would cause the $2^{nd}$ movable contact point 83 to start deformation, the $2^{nd}$ movable contact point 83 will contact the $4^{th}$ fixed terminal 82 to form a closed circuit, and the bulb 23 is lightened to show the action state of the breaker.

Figure 4:
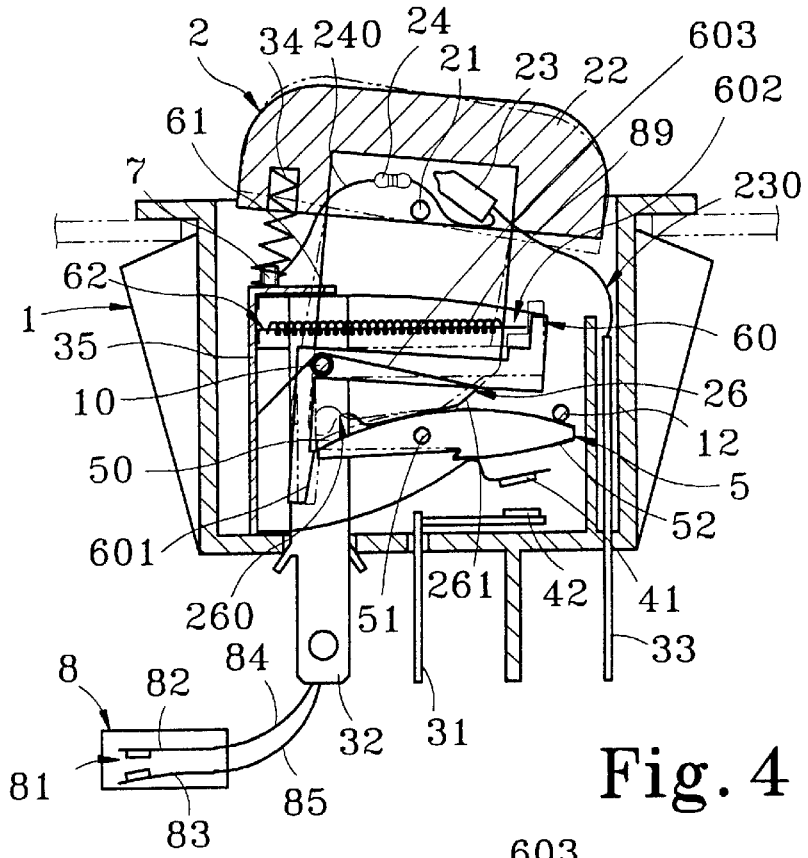
FIG. 4 is a cutaway sectional view of the $1^{st}$ embodiment of this invention showing that the movable element is released to enter the "OPEN" state when overloading.
Figure 5:
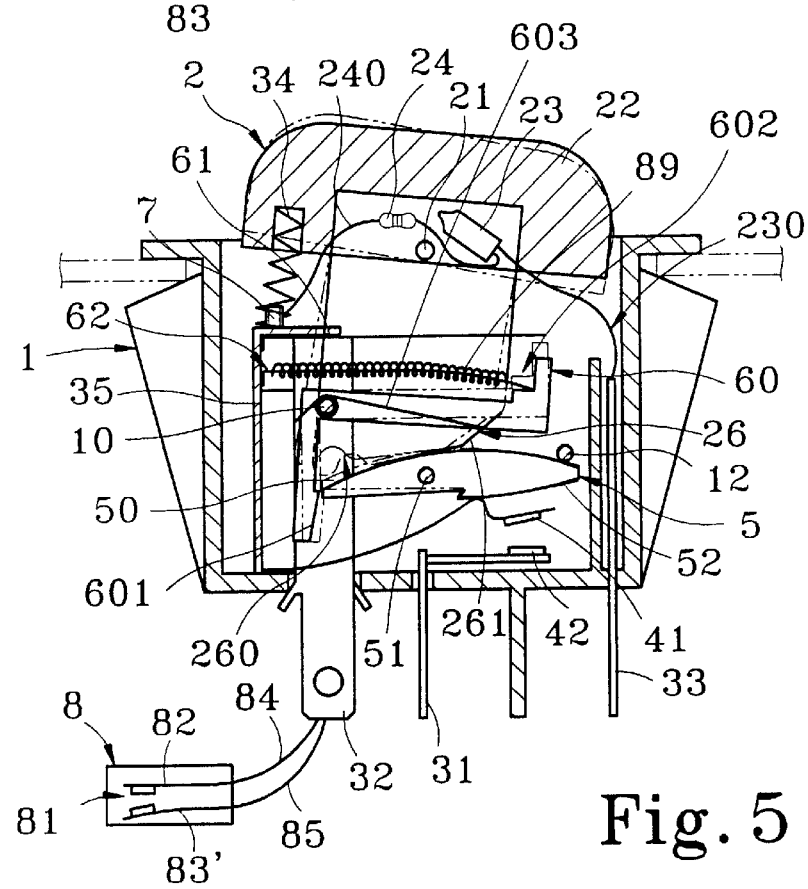
FIG. 5 is a cutaway sectional view of the $1^{st}$ embodiment of this invention showing that the ON/OFF knob has been pushed "CLOSE", and in the case of overheat, the movable level is released to enter the "OPEN" state.

As shown in FIGS. 4 and 5, when breaker is overloaded or the temperature of an electrothermal appliance exceeds the rated critical value of the $2^{nd}$ movable contact point 83, one of the thermal bi-metal strips 61,62 is heated to bend towards the movable article 60, and the push end 613 drives the stop top 602 to enable the movable article 60 to rotate around the pivot article 10 to thus push the reverse hook portion 601 to move backwards and release the supporting portion 50. The movable lever 5 is now pushed by the restoring force of the movable contact point 41 to cause the supporting portion 50 to drop to the $2^{nd}$ support position, and the action point 260 will lose its supporting force due to the backlash of the force-resisting portion 51. Pushing of the spring 34 then causes the ON/OFF knob 2 to return to the state as shown in FIG. 2, while the movable contact points 41,42 are detached to form the normally open state and to push the movable lever 5 upwards.

In the moving up process of the movable lever 5, a disposed stopper 12 above the force applying portion 52 will enable the supporting portion 50 to go back to a position for being hooked by the reverse hook portion 601.

Figure 6:
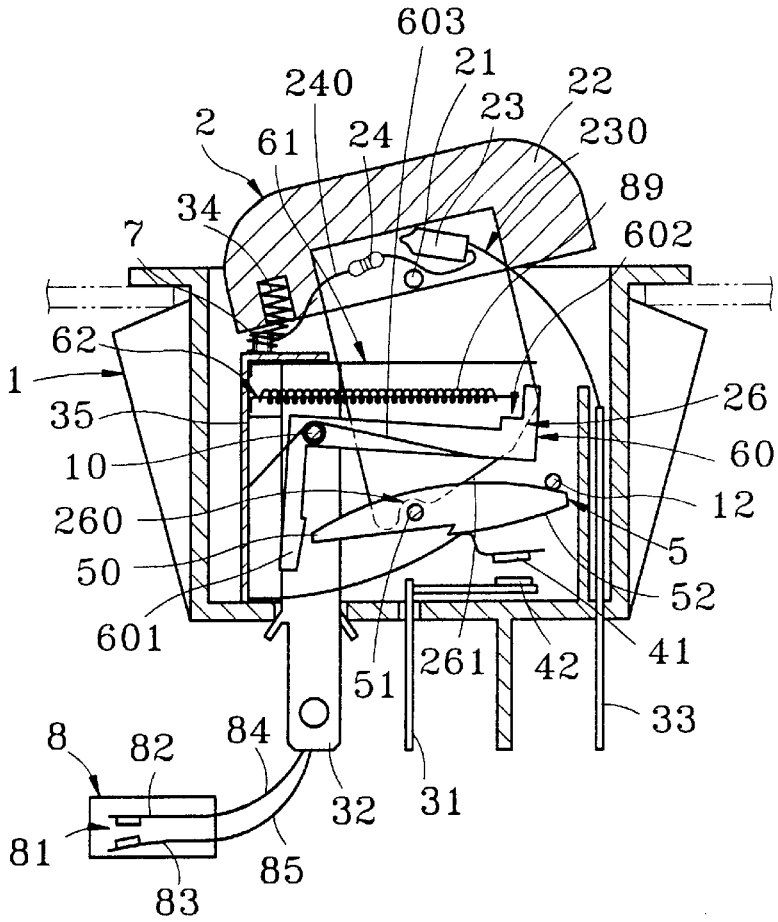
FIG. 6 is a cutaway sectional view of the $1^{st}$ embodiment of this invention. showing that the ON/OFF knob has been pushed to the "CLOSE" state, and in the case of overload, the movable level is released to enter the "OPEN" state.

As shown in FIG. 6, when the ON/OFF knob 2 is pressed "ON" and if overheat is perceived by the thermal-sensing device that imposes overload to the breaker, as the supporting portion 50 has been released to the lower $2^{nd}$ support position, room is still available for the movable contact point 41 to spring upwards and leave the other movable contact point 42 detached. Hence, even if the ON/OFF knob still keeps at "ON", the movable article 60 is supposed to release the movable lever 5 to another $2^{nd}$ support point to enable the movable lever 5 to set the movable contact points 41,42 free to go back to the normally open state. Therefore, this mechanism is capable of responding to overheat or overload at any moment by breaking the power supply for protection of the electric appliance in use and for household security.

Figure 7:
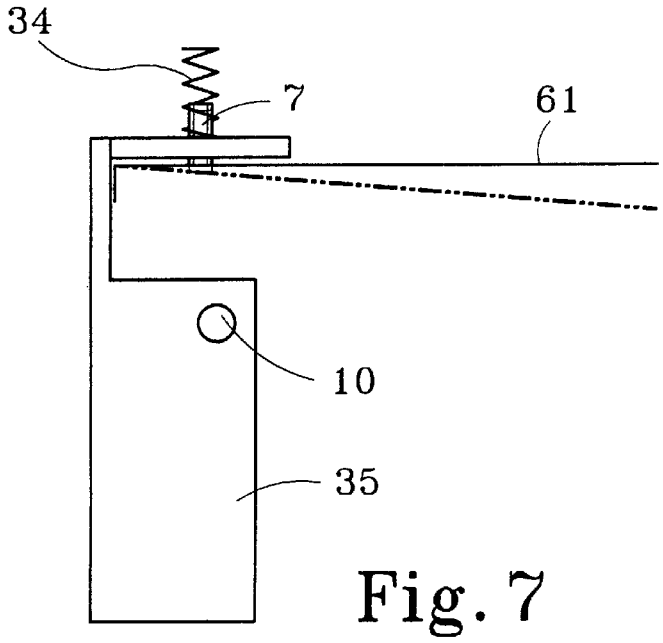
FIG. 7 is a local structure schematic view of the $1^{st}$ embodiment of this invention showing trimming of a thermal bi-metal strip.

As shown in FIGS. 1A and 7, the adaptive article 35 is provided with a trimming element 7 that moves toward and pushes forward the thermal bi-metal strip 61. The trimming element 7 is a bolt movable in its own axis direction between the $1^{st}$ fixed end 611 and push end 613. Movement of the trimming element 7 can change displacement of the push end 613 when the thermal bi-metal strip 61 is bent, and the time period of pushing the movable article 60 to release the supporting portion 50 for alteration of rated load.

In addition, the depth of the reverse hook portion 601 must not be too long. Otherwise, the time period for the movable article 60 to release the supporting portion 50 may be delayed to affect the response speed of the breaker in the case of overload.

Figure 8:
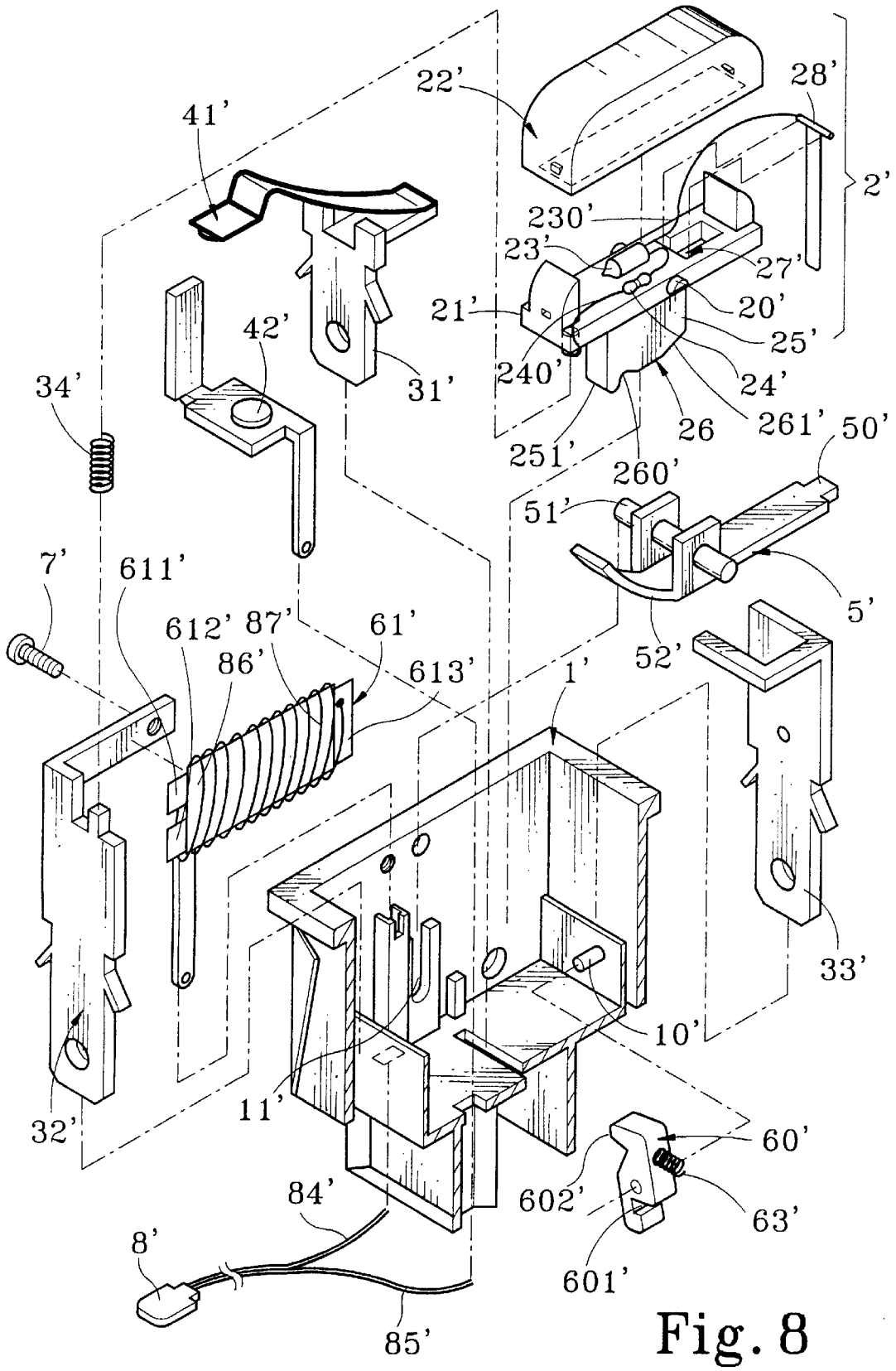
FIG. 8 is an exploded structure view of the $2^{nd}$ embodiment of this invention.
Figure 9:
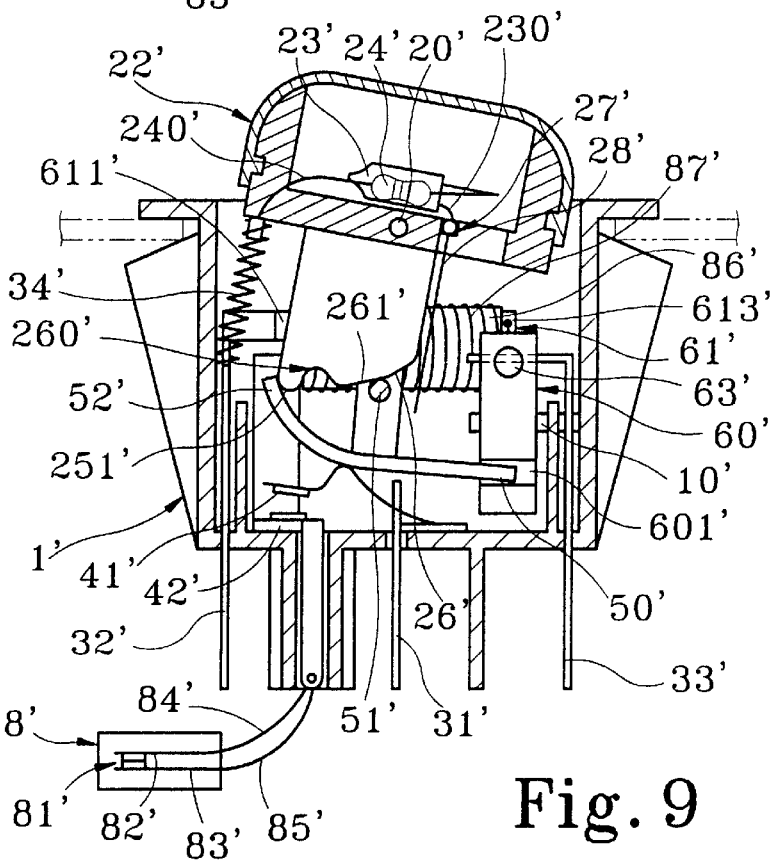
FIG. 9 is a cutaway sectional view of the $2^{nd}$ embodiment of this invention showing the "OPEN" state.

FIGS. 8 and 9 indicate the $2^{nd}$ embodiment of this invention, wherein the breaker comprises: an insulated housing unit 1'; an ON/OFF knob 2' disposed on the housing unit 1' by means of a pivot 20', where the knob can move like a seesaw; a plurality of fixed terminals 31',32',33' inserted in the housing unit 1' for electrical connection to a power supply or devices; a pair of normally open contact points formed by movable contact points 41',42' and $1^{st}$ and $2^{nd}$ fixed terminals 31',32'; a movable lever 5' used to drive the movable contact points 41',42' to form a closed circuit; and a release mechanism used to drive the movable lever 5' to restore back to normally open.

The ON/OFF knob 2' comprises: a swing article 21' provided with the pivot 20', a separable cover 22' combined with the swing article 21', a bulb 23' disposed in the swing article 21', a resistor 24' in connection with the bulb 23' in series, and a spring 34' that pushes the swing article 21' to a normally open position; one end of a conductive wire in connection with a pin 230' of the bulb 23', the other end coupling with a metallic conductive strip 28' disposed in a rectangular hole 27' in the ON/OFF knob 2', wherein the conductive strip 28' is extended downwards from the rectangular hole 27' to form a normally open point with a $3^{rd}$ fixed terminal 33'; the other end 240' of the resistor 24' is in electrical connection with the $2^{nd}$ fixed terminal 32' via the spring 34'.

The ON/OFF knob 2' further includes a trigger 25' located at bottom of the swing article 21'. The trigger swings back and forth to an action or inaction position following seesaw movement of the swing article 21', and contains at least an action face 26' that keeps constant contact with the movable lever 5'. The action face 26' contains an action point 260' and an inaction point 261', which are located on the bottom edge of the action face 26' at two sides, and the distance from the pivot 20' to the action point 260' is slightly longer than that to the inaction point 261'.

The movable lever 5' comprises at least: a supporting portion 50' near the $2^{nd}$ fixed terminal movable within a range confined by $1^{st}$ and $2^{nd}$ support points; a force-applying portion 52' at an opposite end of the supporting portion 50' in constant touch with the movable contact points 41',42'; and a force-resisting portion 51' in constant touch with the action face 26'. The force-resisting portion 51' is limited to reciprocate in a straight line for driving the movable contact point 41' to form with the $1^{st}$ and $2^{nd}$ fixed terminals 31',32', a normally open or closed contact point. As shown in FIG. 8, the movable lever 5' is a trip element basically, and two ends of the cylindrical force-resisting portion 51' are limited to reciprocate in a straight line in a recessed track 11' erected oppositely on an inner wall of the housing unit 1'.

The release mechanism comprises: a movable article 60' keeping the supporting portion 50' at a $1^{st}$ support point; and a thermal bi-metal strip 61' releasing the supporting portion 50' to a $2^{nd}$ support point. The movable article 60' is laid on a pivotal article 10' for pivoting, and at a bottom end of the movable article 60', is formed to maintain the supporting portion 50' at the $1^{st}$ support point. A restoring spring 603' disposed laterally to the movable article 60' is used to enable the gap 601' to normally keep in touch with the supporting portion 50'. The thermal bi-metal strip 61' comprises a $1^{st}$ fixing end 611' anchored at the $2^{nd}$ fixed terminal 32', a $2^{nd}$ fixing end 612' anchored at the movable contact point 42', and a push end 613' at top end 602' to drive the movable article 60' when the thermal bi-metal strip 61' is heated to bend.

The thermal-sensing device is packed in a casing unit 8', wherein a sensing mechanism 81' is provided, which contains a $4^{th}$ fixed point 82' and a $2^{nd}$ movable contact point 83' made of a thermal bi-metal strip. The $4^{th}$ fixed point 82' and the $2^{nd}$ movable contact point 83' are in electrical connection to the thermal bi-metal strip 61' and the movable contact point 42' respectively via lead wires 84',85' to combine with the breaker in parallel connection. A rear end of the lead wire 84' is coupled to a heating coil 87' which is wound on an insulation layer 86' disposed on outer surface of the thermal bi-metal strip 61'. In the case of overheat, the $2^{nd}$ movable contact point 83' will deform to detach from the $4^{th}$ fixed point 82' to enter the "OFF" state. Meanwhile, the thermal bi-metal strip 61' is heated to bend to push the movable article 60' owing to high temperature of the heating coil 87'.

Figure 10:
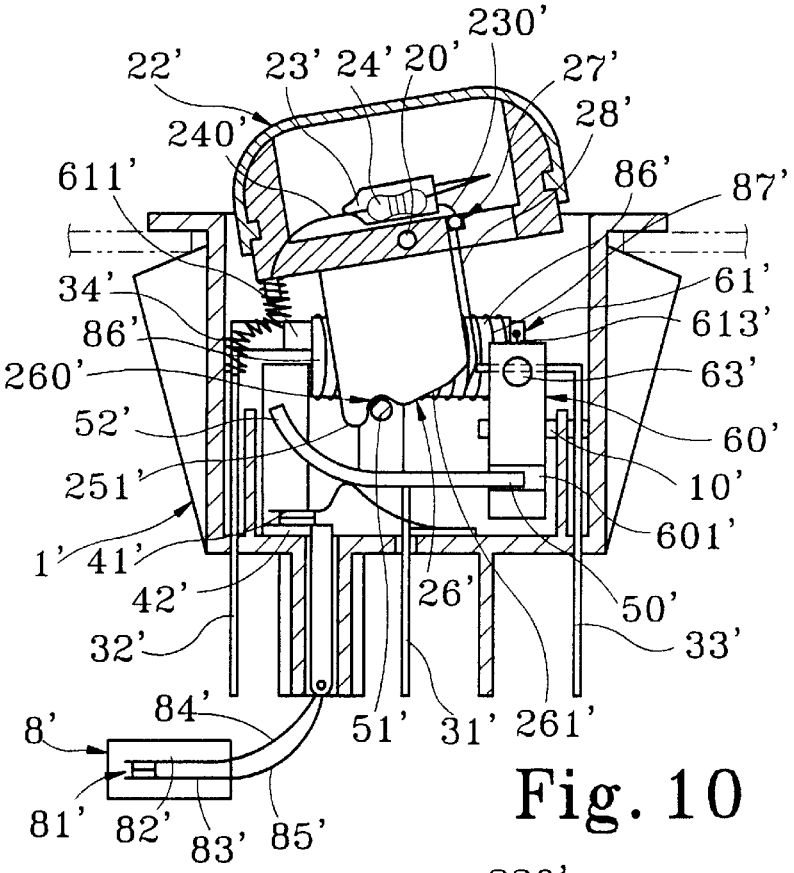
FIG. 10 is a cutaway sectional view of the $2^{nd}$ embodiment of this invention showing the "CLOSE" state.

As shown in FIG. 9, when the breaker is in an "OPEN" state, the force-resisting portion 51' is sitting on the inaction point 261' and is pushed to cock up by elastic force of the movable contact point 41', while the supporting portion 50' is hooked at the $1^{st}$ support position by the gap 601'. As the movable contact points 41',42' are detached from each other under this circumstance, power wires connected to the $1^{st}$ and the $2^{nd}$ fixed terminals 31',32' respectively cannot form a closed circuit, so that no current is flowing into the thermal bi-metal strip 61' via the movable contact point 42'. On the contrary, when the ON/OFF knob 2' is pushed to enter a state as shown in FIG. 10, the force-resisting portion 51' moves to the action point 260' along the action face 26', and as the distance between the action point 260' and the pivot 20' is greater than that between the inaction point 261' and the pivot 20', the force applying portion 52' presses the movable contact point 41' to contact another movable contact point 42' to form a closed circuit via the thermal bi-metal strip 61'. Thus, the electrical appliance in connection with the breaker will be activated. Meanwhile, as long as the temperature of an electrothermal appliance is lower than a critical temperature that would cause the $2^{nd}$ movable contact point 83' to start deformation, the $2^{nd}$ movable contact point 83' will contact the $4^{th}$ fixed terminal 82' to form a closed circuit, and the bulb 23' is lightened as the pin 230' contacts the $3^{rd}$ fixed terminal 33' to show the action state of the breaker.

Figure 11:
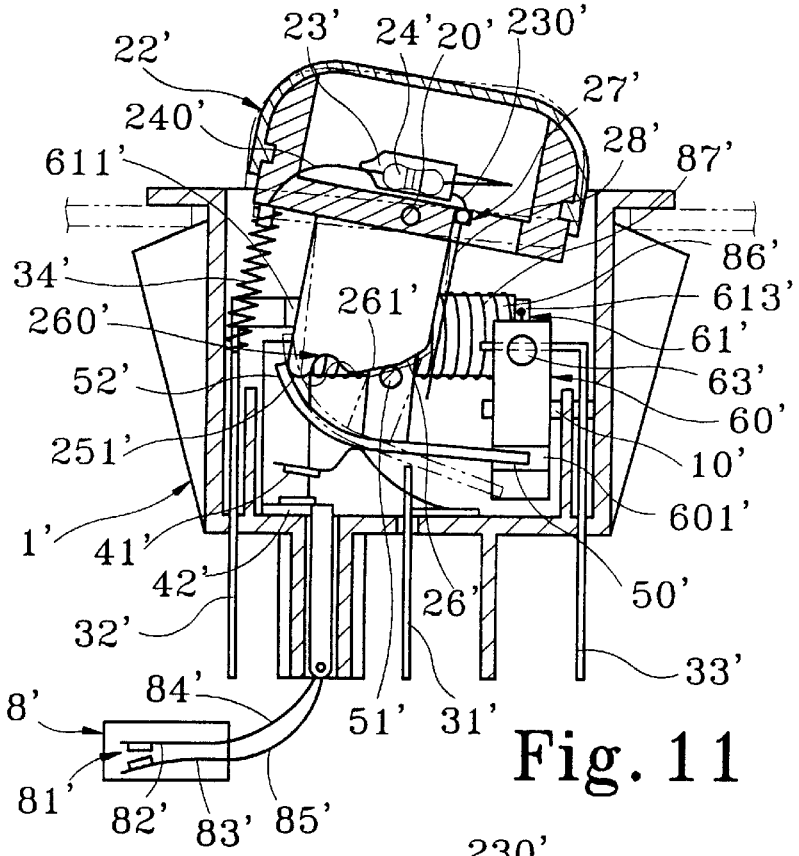
FIG. 11 is a cutaway sectional view of the $2^{nd}$ embodiment of this invention showing the movable element is released when overloading to enter the "OPEN" state.
Figure 13:
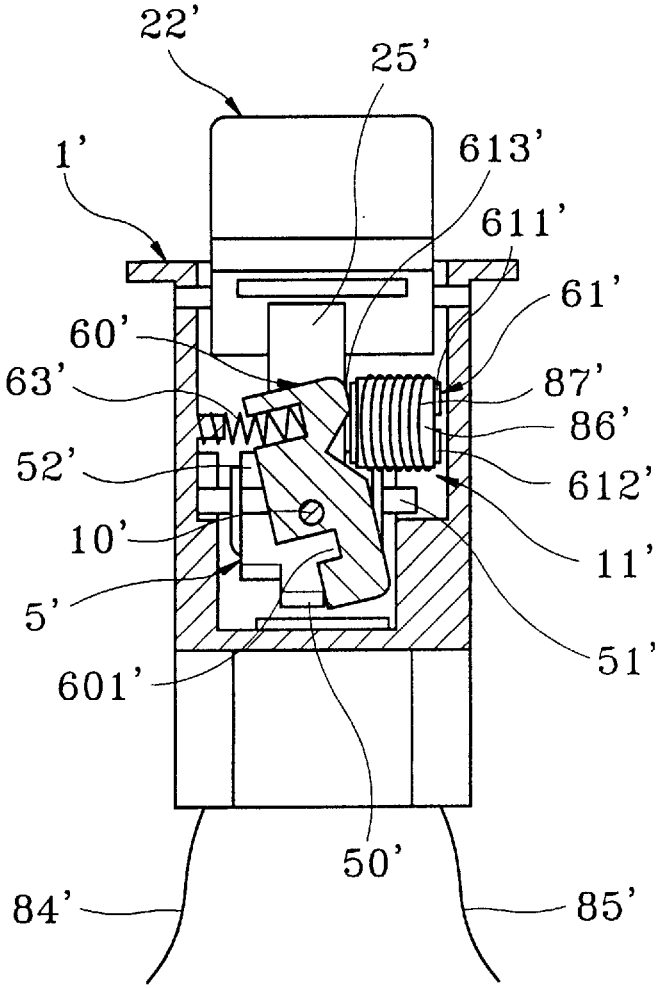
FIG. 13 is another cutaway sectional view of the $2^{nd}$ embodiment of this invention showing action of the release mechanism.

As shown in FIGS. 10 and 11, when breaker is overloaded or the temperature of an electrothermal appliance exceeds rated critical value of the $2^{nd}$ movable contact point 83', the thermal bi-metal strip 61' is heated to bend towards the movable article 60', and the push end 613' drives the top end 602' of the movable article 60' to enable the gap 601' to move backwards and release the supporting portion 50' as shown in FIG. 13. The movable lever 5' is now pushed by the restoring force of the movable contact point 41' to cause the supporting portion 50' to drop to the $2^{nd}$ support position, and the action point 260' loses supporting force due to the backlash of the force-resisting portion 51'. Then, pushing of the spring 34' causes the ON/OFF knob 2' to return back to the state as shown in FIG. 9, while the movable contact points 41',42' are detached to enter the normally open state to push the movable lever 5' upwards.

In the moving up process of the movable lever 5', the force applying portion 52' must be slightly bent upwards, so that a front end 251' of the trigger 25' can push the curving part of the force applying portion 52', to force the supporting portion 50' to return to a position for being hooked by the gap 601' when the trigger 25' goes back to the position shown in FIG. 9.

Figure 12:
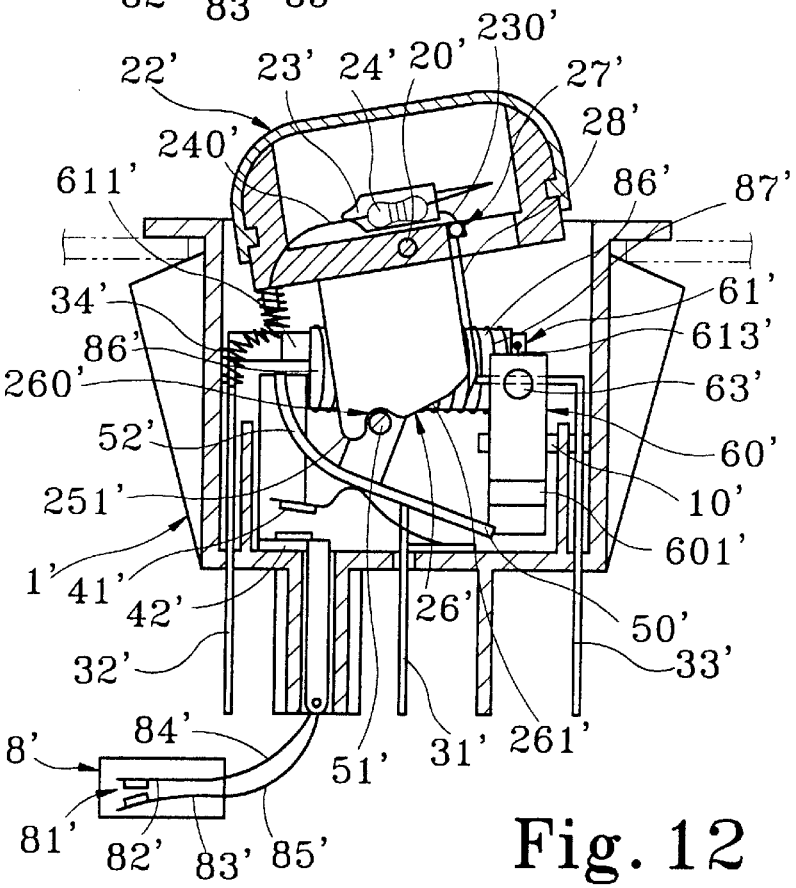
FIG. 12 is another cutaway sectional view of the $2^{nd}$ embodiment of this invention showing the ON/OFF knob has been pushed to the "CLOSE" state, and in the case of overload, the movable knob is released to enter the "OPEN" state.

As shown in FIG. 12, when the ON/OFF knob 2' is pressed "ON" and if overheat is perceived by the thermal-sensing device that imposes overload on the breaker, as the supporting portion 50' has been released to the lower $2^{nd}$ support position, room is still available for the movable contact point 41' to spring upwards and leave the other movable contact point 42' detached. Hence, even if the ON/OFF knob stays in an "ON" position, the movable article 60' is supposed to release the movable lever 5' to another $2^{nd}$ support point to enable the movable lever 5' to set the movable contact points 41',42' free to go back to the normally open state. Therefore, this mechanism is capable of responding to overheat or overload at any moment by breaking the power supply for protection of the electrical appliance in use and for household security.

Figure 14:
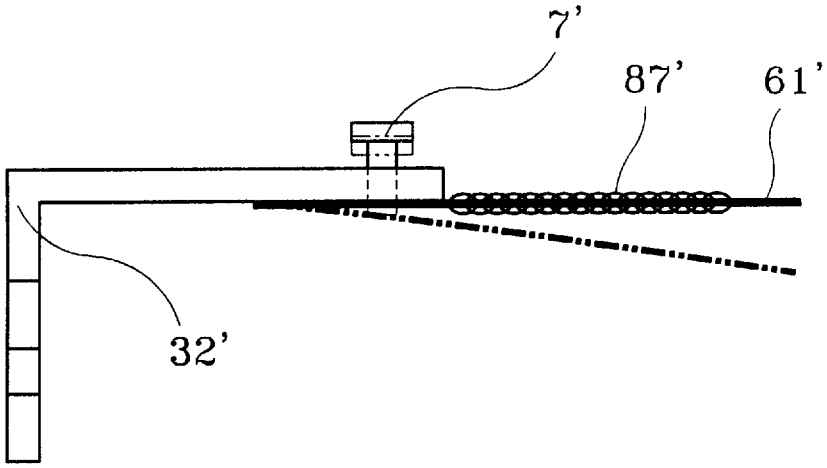
FIG. 14 is a local structure view of the $2^{nd}$ embodiment of this invention showing trimming of a thermal bi-metal strip.

As shown in FIGS. 8 and 14, the $2^{nd}$ fixed terminal 32' is provided with a trimming element 7' that moves toward and pushes forward the thermal bi-metal strip 61'. The trimming element 7' is a bolt movable in its own axis direction between the $1^{st}$ fixed end 611' and push end 613'. Movement of the trimming element 7' can change displacement of the push end 613' when the thermal bi-metal strip 61' is bent, and the time period of pushing the movable article 60' to release the supporting portion 50' for alteration of the rated load.

In addition, the depth of the gap 601' must not be too deep. Otherwise, the time period for the movable article 60' to release the supporting portion 50' may be delayed and affect response speed of the breaker in the case of overload.

In short, this invention combines a thermal-sensing device with a breaker for the purpose of sensing temperature and current concurrently, and the thermal-sensing device used in this invention may be substituted by other analogous elements.

What is claimed is:

1. An overheat and overload sensing device, comprising:

a breaker including first and second fixed terminals, one of which is arranged to be connected to a power supply and another of which is arranged to be connected to an electric appliance, said breaker including:

a first movable contact arranged to connect said first and second fixed terminals to each other and biased into an open state;

an ON/OFF knob arranged to be operated by a user to rotate around a pivot;

a movable lever linked with said ON/OFF knob, said movable lever being pivotable by said user about a first support point to move said first movable contact into a closed state in which said first movable contact connects said first and second fixed terminals when said breaker is not overloaded;

a linked release mechanism arranged to release said movable lever during an overload, wherein release of said movable lever causes the movable lever to move to a second support point, wherein movement of the movable lever to the second support point releases said first movable contact, and wherein release of said first movable contact causes said first movable contact to return to an open state;

a thermal sensing device including a sensing mechanism, said sensing mechanism comprising a fourth fixed terminal and a normally closed second movable contact connected in parallel with said breaker, wherein in case of an overheat, said second movable contact deforms and detaches from said fourth fixed terminal, causing an overload in said breaker, said overload in said breaker resulting in release of said movable lever, movement of the movable lever from the first support point to the second support point, release of the movable contact, and return of said first movable contact to an open state, thereby disconnecting said first and second fixed terminals.

2. An overheat and overload sensing device as claimed in claim 1, wherein said ON/OFF knob comprises a swinging member having a pivot, a cover fixed to said swinging member, and a spring arranged to bias said swinging member into an open position.

3. An overheat and overload sensing device as claimed in claim 2, wherein said ON/OFF knob further includes a trigger disposed at a bottom of said swinging member, said trigger being movable with said swinging member from an action position to an inaction position, wherein said trigger includes an action face engageable with said movable lever, said action face including an action point and an inaction point, and wherein a distance from said action point to said pivot is longer than a distance from said inaction point to said pivot.

4. An overheat and overload sensing device as claimed in claim 3, wherein said movable lever comprises a supporting portion located at a radial end of said movable lever, said supporting portion being movable between said first and second support points, and wherein said movable lever further comprises a force resisting portion in engagement with said action face, said force resisting portion being arranged to reciprocate in a straight line for causing movement of said first movable contact into said closed state.

5. An overheat and overload sensing device as claimed in claim 4, wherein said release mechanism includes a movable article arranged to keep said supporting portion at the first support point, and a thermal bi-metal strip for causing said movable article to move and thereby release said supporting portion, causing the supporting portion to move to said second support point.

6. An overheat and overload sensing device as claimed in claim 5, wherein said fourth fixed terminal and said second movable contact are respectively electrically connected to said thermal bi-metal strip and said first movable contact by conductive wires and electrically connected in parallel with said breaker, and wherein one end of the conductive wire connection to the thermal bi-metal strip includes a heating coil wound on an insulation layer that encloses said bi-metal strip, wherein said second movable contact deforms to detach from said fourth fixed terminal to disconnect said third and fourth fixed terminals in case of overheat while said thermal bi-metal strip is heated to bend and push said movable article as a result of a high temperature of said heating coil.

7. An overheat and overload sensing device as claimed in claim 5, wherein said movable article is arranged to rotate around a pivot article and a reverse hook portion is provided at a bottom of said movable article to retain said supporting portion at said first support point, and wherein a restoring spring is disposed laterally with respect to said movable article and arranged to push said movable article and enable said reverse hook portion to normally hold said supporting portion at the first support point.

8. An overheat and overload sensing device as claimed in claim 5, wherein said thermal bi-metal strip includes a first fixed end anchored at an adaptive article electrically connected to the movable contact, a second fixed end anchored at said second fixed terminal, and a push end arranged to push against a stepped top of said movable article when said thermal bi-metal strip is heated to bend.

9. An overheat and overload sensing device as claimed in claim 5, wherein said movable article is arranged to rotate about a center of the movable article, a gap is formed at a bottom of the movable article with an opening facing said supporting portion so as to enable said movable article to hook said supporting portion in said first support position, and a restoring spring is disposed at a second radial end of the movable article to push said movable article and enable said movable article to normally hook said supporting portion.

10. An overheat and overload sensing device as claimed in claim 5, wherein said thermal bi-metal strip comprises a first fixed end anchored at said second fixed terminal and a second fixed end anchored at said first movable contact, and wherein said bi-metal strip further comprises a push end arranged to push said movable article when said thermal bi-metal strip is heated to bend.

* * * * *